US011164549B1

(12) United States Patent
Baird

(10) Patent No.: US 11,164,549 B1
(45) Date of Patent: Nov. 2, 2021

(54) INSTRUMENT STRING GUIDE

(71) Applicant: Derrick Baird, Norris, TN (US)

(72) Inventor: Derrick Baird, Norris, TN (US)

( * ) Notice: Subject to any disclaimer, the term of this patent is extended or adjusted under 35 U.S.C. 154(b) by 0 days.

(21) Appl. No.: 16/946,710

(22) Filed: Jul. 1, 2020

(51) Int. Cl.
*G10D 3/12* (2020.01)
*G10D 1/08* (2006.01)
*G10D 3/14* (2020.01)

(52) U.S. Cl.
CPC ..... *G10D 3/12* (2013.01); *G10D 1/08* (2013.01); *G10D 3/14* (2013.01)

(58) Field of Classification Search
CPC ..... G10D 3/12; G10D 1/08; G10D 3/14
See application file for complete search history.

(56) References Cited

U.S. PATENT DOCUMENTS 4,206,679 A * 6/1980 Wilson ..... G10D 3/12 84/314 N
4,248,127 A * 2/1981 Lieber ..... G10D 3/12 84/297 R
D685,410 S 7/2013 Chaput
9,972,289 B2 5/2018 Artino
2011/0036228 A1* 2/2011 Deck ..... G10D 3/153 84/313

OTHER PUBLICATIONS

String Butler By Sven Dietrich, www.string-butler.com, Halle Saale, Germany , Sep. 26, 2020.
Wilkinson LP Style Truss Roller Cover By Wilkkinson, reverb.com Listing of Rare Part https://reverb.com/marketplace?query=wilkinson%20nut%20roller, Sep. 26, 2020.

* cited by examiner

*Primary Examiner* — Kimberly R Lockett

(57) ABSTRACT

An instrument string guide for changing the path of a string on a musical instrument is disclosed. The instrument string guide engages the musical instrument string between the end of operational length and point of string termination. This device comprises a base 1 and tapered radiused slot 2 to attach to the musical instrument. The tapered radiused slot 2 keeps the devise attached to the musical instrument. The tapered radiused slot also guides the string around the radiused edge more easily to reduce friction. The instrument string guide rests against a part of the instrument to become stationary.

6 Claims, 4 Drawing Sheets

INSTRUMENT STRING GUIDE

BACKGROUND

On various stringed musical instruments the geometry of the string path can cause tuning stability issues. For example, the three per side style headstock of a guitar presents a side force inside the slot of the nut when the path of the strings to the tuners is offset from the strings over the fretboard. The force from the downward headstock angle also acts on the slot in the nut. These forces combine in the slot of the nut and cause tuning issues since the string cannot slide over the nut freely. The back of the nut does not always have a radius large enough allow the string to gently bend toward the tuners thus causing additional binding. This tuning issue is most notable on electric guitars due to string bending to increase the pitch. During bending the string is required to slide over the nut. The string does not return to the original position and the pitch is affected.

There have been and are currently devices on the market to address the issue of a bent string path for guitars. These devices also have disadvantages. The first device is the Wilkinson string guide truss rod cover. This device has rollers on a truss rod cover guiding the string straight over the nut. The disadvantage is the truss rod cover is only made to work with a specific guitar and requires tools for installation. Another device is called the String Butler. It uses a plate with journal bearings and the plate is secured under the threaded fasteners of the tuners. The disadvantage to this is it requires removal of existing machine tuner fasteners and some tuners do not have these fasteners. U.S. Pat. No. 8,779,259 to Herrmann (2014) shows individual rollers attached to the headstock of a guitar. This type of device requires tools and permanent modification to the instrument.

SUMMARY

An embodiment of the present invention addresses these issues and others by providing an instrument string guide that requires no tools for attachment and provides a smooth radius to prevent binding. One example of an instrument string guide uses a base with conical slots to redirect musical instrument strings. The instrument string guide locates between the first and second rows of the machine tuners on the headstock. The instrument string guide attaches to the instrument by balancing the forces of the string going through the conical slot and that of the base touching the tuners.

The taper of the conical surface keeps the device engaged with the strings. The symmetry of the string surfaces keeps the device laterally balanced and closely aligned with the location of the strings in the nut.

DRAWINGS—REFERENCE NUMERALS

Figure 1:
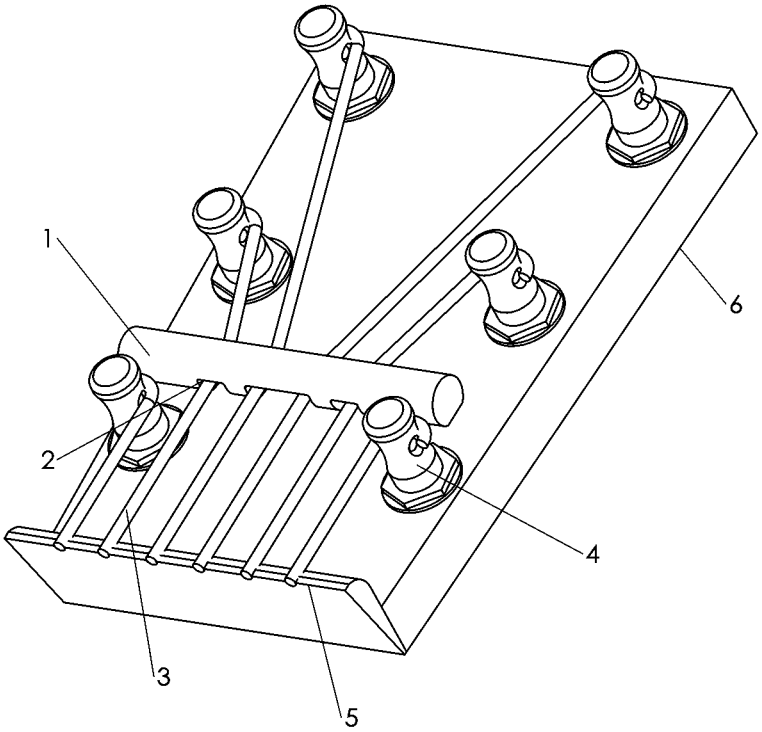
FIG. 1 is a top perspective view of an instrument string guide attached to a musical instrument according to the preferred embodiment.

1 base
2 conical surface
3 string
4 machine tuner
5 nut
6 headstock
7 instrument string guide

DETAILED DESCRIPTION

Figure 2A:
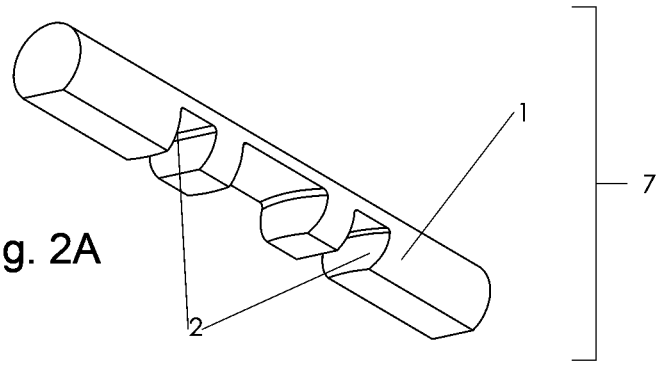
FIG. 2A is a bottom perspective view of an instrument string guide in FIG. 1.

FIG. 1 is a perspective view according to this embodiment of an instrument string guide 7. FIG. 1 is a perspective view to show this embodiment in use on a guitar headstock 6 with three per side machine tuners 4. FIG. 2A is a perspective view of this embodiment from underneath. The instrument string guide has a base 1 with at least one set of diametrically opposed conical surfaces 2 at its bottom.

Figure 2B:
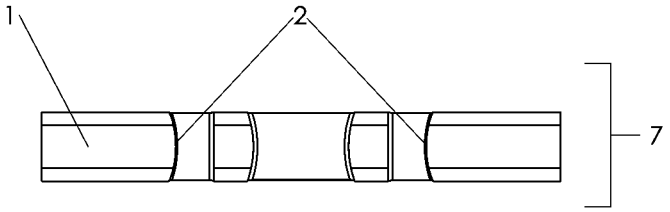
FIG. 2B is a bottom view of an instrument string guide in FIG. 1.

FIG. 2B is a bottom view of this embodiment to emphasize the radius of the conical surface 2.

Figure 2C:
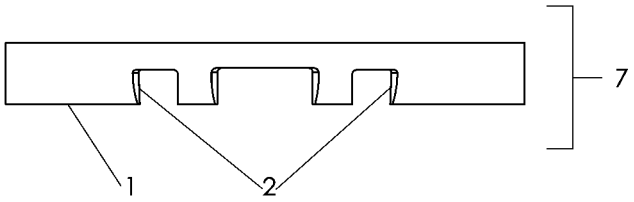
FIG. 2C is a front view of an instrument string guide in FIG. 1.

FIG. 2C is a front view of this embodiment to emphasize the taper of the conical surface 2.

Figure 3:
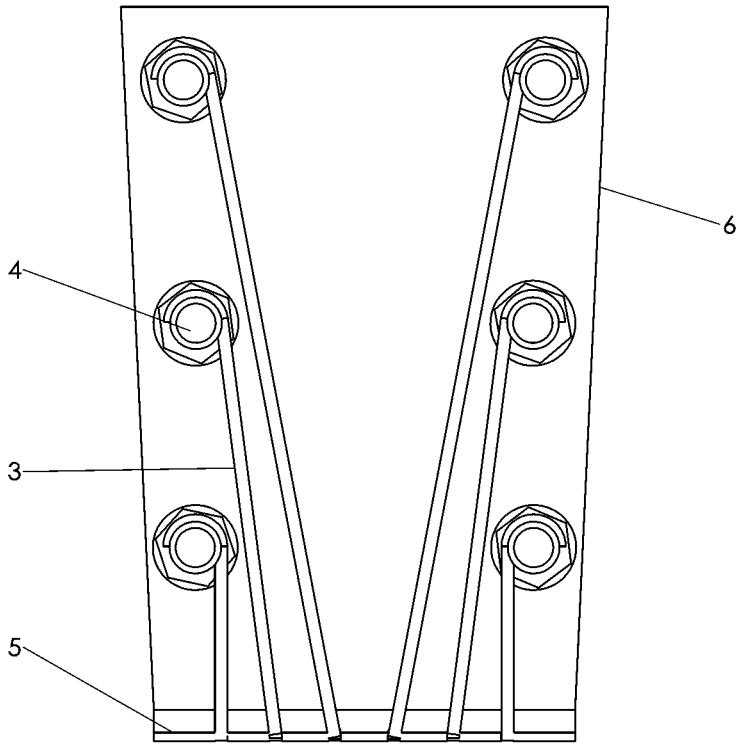
FIG. 3 is a top view of a musical instrument headstock without the instrument string guide attached.
Figure 4:
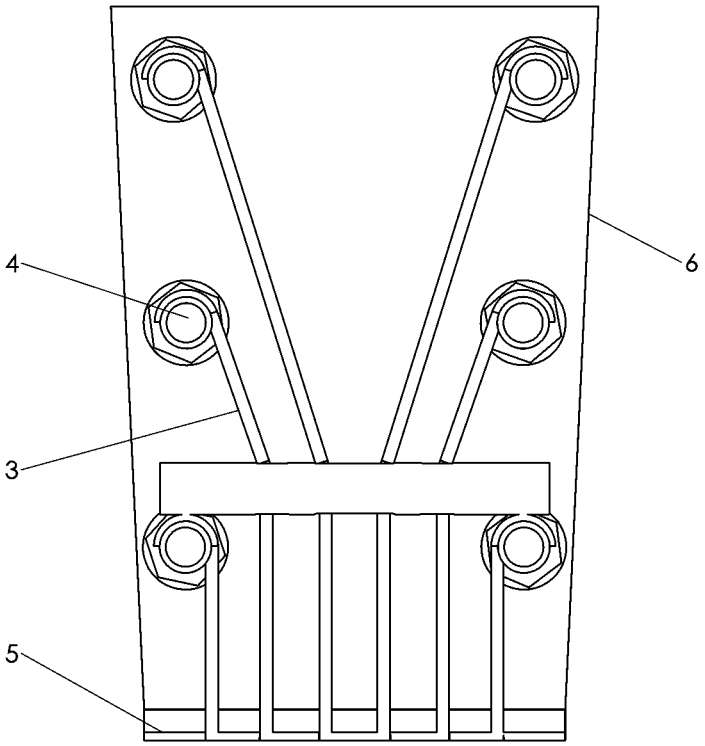
FIG. 4 is top view of a musical instrument headstock with the instrument string guide attached.

In operation one uses the instrument string guide 7 to alter the path of a string 3 between the nut 5 and machine tuner 4 on a musical instrument. FIG. 3 is a top view of the instrument headstock with unaltered position of the string 3. FIG. 4 is a top view of the preferred embodiment in FIG. 1 and demonstrates the change of the string 3 path in FIG. 3. The instrument string guide 7 attaches to string 3 of the musical instrument by opposing forces between the conical surfaces 2. The instrument string guide 7 is further positioned on the strings 3 between the machine tuners 4 row one and two with base 1 against the machine tuner 4 of row one to completely balance the forces.

There are many possibilities with regard to the type of situations in which this instrument string guide would be of use. The basic function of the instrument string guide 7 is to alter the path of an instrument string 3 and therefore alter string friction at the nut 5 to prevent tuning instability. Many different types of musical instruments can utilize such a device such as guitar and bass. With adjustment of the conical surface 2 location many string spacing can be accommodated.

There are other ways by which the base can be attached to the musical instrument. Another way for attachment would be with a hook around the machine tuner coming from the base with the instrument string guide located between the nut 5 and first row of machine tuners 4 (not shown).

Accordingly, it will be appreciated that the embodiments of an instrument string guide can be used to alter the path of an instrument string. This device can eliminate the need for modification of a musical instrument to achieve such alteration. This devise can also be used on multiple types of instruments since it is simple to attach. Although the description above contains much specificity, this description should not be construed as limiting the scope of the invention but as merely providing illustrations of exemplary embodiments of this invention.

The invention claimed is:

1. An instrument string guide, comprising:

a unitary base with a top surface and a bottom surface having, diametrically opposed conical surfaces on said bottom surface providing means for attachment to non-parallel musical instrument strings; said unitary base attached beyond a musical instrument string operational length, whereby said conical surfaces engage said non-parallel musical instrument strings beyond said musical instrument string operational length, said unitary base made stationary against a part of a musical instrument, thereby reducing lateral friction at a musical instrument string support by closely aligning said musical instrument string path beyond said musical instrument string operational length thereby providing a less acute lateral string transition surface.

2. The instrument string guide of claim 1, wherein said beyond musical instrument string operational length, is between a nut and a tuner of said musical instrument.

3. The instrument string guide of claim 2, wherein said musical instrument is a banjo, guitar, or other stringed musical instrument.

4. The instrument string guide of claim 1, wherein said part of a musical instrument is a machine tuner.

5. The instrument string guide of claim 1, wherein said part of a musical instrument is said nut.

6. The instrument string guide of claim 1, wherein said radius of said diametrically opposed conical surfaces reduces friction between said surfaces and said musical instrument string.

* * * * *